US007866572B2

(12) United States Patent
Ichige

(10) Patent No.: US 7,866,572 B2
(45) Date of Patent: Jan. 11, 2011

(54) BUBBLE-GENERATING STRUCTURE, AND SHOWERHEAD THAT INCLUDES THAT STRUCTURE

(75) Inventor: Toukichi Ichige, Tokyo (JP)

(73) Assignee: Saiseiko Co., Ltd (JP)

( * ) Notice: Subject to any disclaimer, the term of this patent is extended or adjusted under 35 U.S.C. 154(b) by 0 days.

(21) Appl. No.: 12/097,483

(22) PCT Filed: Dec. 12, 2006

(86) PCT No.: PCT/JP2006/324782

§ 371 (c)(1),
(2), (4) Date: Jun. 13, 2008

(87) PCT Pub. No.: WO2007/069616

PCT Pub. Date: Jun. 21, 2007

(65) Prior Publication Data

US 2009/0090793 A1 Apr. 9, 2009

(30) Foreign Application Priority Data

Dec. 13, 2005 (JP) ..... 2005-359612

(51) Int. Cl.
*F23D 11/10* (2006.01)
*F23D 14/62* (2006.01)
*E03C 1/08* (2006.01)
*B05B 7/06* (2006.01)

(52) U.S. Cl. ..... 239/428.5; 239/418; 239/419; 239/419.5; 239/432

(58) Field of Classification Search ..... 239/418, 239/419, 419.5, 428.5, 432
See application file for complete search history.

(56) References Cited

U.S. PATENT DOCUMENTS 2,069,733 A * 2/1937 Zinkil ..... 239/403
3,701,482 A * 10/1972 Sachnik ..... 239/590.3
4,135,670 A * 1/1979 Sugimoto ..... 239/428.5
4,573,639 A * 3/1986 Logue ..... 239/428.5
5,085,371 A * 2/1992 Paige ..... 239/343
5,826,799 A * 10/1998 Hsieh ..... 239/428.5

(Continued)

FOREIGN PATENT DOCUMENTS

JP 56-87446 A 7/1981

(Continued)

*Primary Examiner*—Len Tran
*Assistant Examiner*—Ryan Reis
(74) *Attorney, Agent, or Firm*—Lowe Hauptman Ham & Berner, LLP

(57) ABSTRACT

Using a simple structure, a new function is added to a liquid such as tap water by taking a gas into the liquid. The bubble-generating structure of the present invention includes (1) a water-discharging nozzle, which is provided inside a pipe, (2) a receiving member, which is situated a specified distance from the water-discharging nozzle and which includes a flow path for passing liquid emitted from the water-discharging nozzle, and (3) an air hole provided in such a way as to take air into a space between the water-discharging nozzle and the receiving member. By taking in air due to a suction force that is generated when the liquid passes along the flow path, bubbles are generated in the liquid. When such a structure for generating bubbles in the liquid is included in a showerhead, a person taking a shower using the showerhead can have a healthy and comfortable feeling while showering.

1 Claim, 7 Drawing Sheets

U.S. PATENT DOCUMENTS 6,270,022 B1 * 8/2001 Knapp ..... 239/428.5

FOREIGN PATENT DOCUMENTS

JP 8-215614 A 8/1996
JP 9-990 A 1/1997
JP 11-104523 A 4/1999
JP 11-151457 A 8/1999
JP 2001-333867 A 12/2001
JP 2002-102100 A 4/2002
JP 2002-336740 A 11/2002

* cited by examiner

BUBBLE-GENERATING STRUCTURE, AND SHOWERHEAD THAT INCLUDES THAT STRUCTURE

CROSS-REFERENCE TO RELATED APPLICATIONS

The present Application is based on International Application No. PCT/JP2006/324781, filed on Dec. 12, 2006, which in turn corresponds to Japanese Application No. 2005-359612 filed on Dec. 13, 2005, and priority is hereby claimed under 35 USC §119 based on these applications. Each of these applications are hereby incorporated by reference in their entirety into the present application.

FIELD OF THE INVENTION

The present invention relates to a structure for causing a liquid to contain bubbles and then to emit the liquid, and to a showerhead that includes that structure.

BACKGROUND OF THE INVENTION

A normal showerhead that is used when taking a shower is equipped with a switching lever or a push button so as to control the volume and strength of the tap water to be emitted. In addition, a filter or the like can be installed in a showerhead in order to emit the tap water in a misty form, to activate the tap water by using ceramics or the like, or to remove harmful chlorine and so on from the tap water. Japanese Published Patent Application No. H11-151457 discloses a spray nozzle and a shower apparatus that uses that spray nozzle. In the spray nozzle described in that application, the spray nozzle's swirl holes swirl a liquid (i.e. create a swirling flow), and the spray nozzle's central hole forms a flow along the central axis of the swirling flow, so that—even if the liquid's pressure is low—sprayed water particles can be fine and uniform and the spraying angle can be large. Also, in the shower apparatus disclosed in Japanese Published Patent Application No. 2001-333867, a plurality of spray nozzles are provided inside a showerhead, an emission port is provided in front of each of the spray nozzles, and air ports are provided behind the spray nozzles. Thus, misty warm water is emitted from the spray nozzles, and the emitted misty water (mists) entrains air from the air ports. Accordingly, both misty warm water and air are supplied to the person who is showering. In addition, the mists emitted from the plurality of spray nozzles collide with each other in an airflow, and thereby generate negative ions.

Patent Document 1: Japanese Published Patent Application No. H11-151457

Patent Document 2: Japanese Published Patent Application No. 2001-333867

SUMMARY OF THE INVENTION

One objective of the prevent invention is to cause a liquid (such as tap water) to contain a gas (such as air) and to generate bubbles, so that a new function is added to the liquid.

The bubble-generating structure of the present invention includes a water-discharging nozzle, which is provided inside a pipe, a receiving member, which is situated a specified distance from the water-discharging nozzle and which includes a flow path for passing the liquid emitted from the water-discharging nozzle, and an open air hole that takes air into the space between the water-discharging nozzle and the receiving member, and wherein the structure bubbles are generated in the liquid due to the air taken in by the suction force that is generated when the liquid passes along the flow path.

The showerhead of the present invention, in which a mounting member—to be mounted to a tap-water outlet—is provided at the base end of a tubular outer member, with the showerhead includes a water-discharging nozzle, which is provided in the mounting member and which has a diameter smaller than that of the tap-water outlet, and a receiving member, which is situated a specified distance from and opposite to the water-discharging nozzle, and which includes a flow path for passing the liquid emitted from the water-discharging nozzle, and wherein the showerhead air is taken in at the place where the outer member contacts the mounting member, and due to the suction force that is generated when the tap water emitted from the water-discharging nozzle passes along the flow path, the air is taken in and the water is discharged.

In addition, the mounting member has a mounting part that is screwed to a screw part provided inside the outer member, a flange that contacts the water-inlet end of the outer member, a mounting part that projects outward from the flange, a vertical groove on the outside of the mounting part, and an open air hole at the top of the groove.

Furthermore, the showerhead of the present invention is configured such that a head part having a water-discharging piece for discharging tap water is screwed by a grip part that cab be gripped by a person's hand, and the showerhead includes of a suction member that sucks air into the suction member. The suction member has a water-discharging nozzle inside a tubular member, and a receiving member, which is situated a specified distance from and opposite to the water-discharging nozzle, and to which receiving member a flow path is provided for passing the liquid emitted from the water-discharging nozzle. There are provided, at the place where the head part contacts the gripping part, a first through-hole, which is provided through the wall of the tubular member and is located between the water-discharging nozzle and the receiving member; an indentation, which is formed at one part of the head part, and a second through-hole, which takes in air through the indentation; and air is taken in through the first and second through-holes, due to the suction force that is generated when tap water emitted from the water-discharging nozzle passes along the flow path, so that the water is discharged.

In addition, the showerhead of the present invention has at an intermediate part of the receiving member's flow path, a space whose diameter is larger than the diameters of other portions of the flow path.

When there is provided a configuration wherein a water-discharging nozzle is arranged inside a tubular body, a receiving member is arranged at a specified distance from the water-discharging nozzle, and air can be taken into a space between the water-discharging nozzle and the receiving member, it is possible to generate bubbles in a liquid that passes through the tubular body. Such a liquid, which has taken in air, contains a large amount of bubbles. Therefore, the liquid can be utilized, for example, by being incorporated in a liquid-purifying device or the like.

In addition, such a structure that generates bubbles inside a showerhead, stimulates ceramics arranged inside the showerhead, and the tap water discharged from the showerhead contains a large amount of bubbles. This gives a healthy and comfortable feeling to a person who takes a shower using this showerhead.

Furthermore, when a space having an enlarged diameter is provided at an intermediate part of the receiving member's flow path, tap water becomes agitated in that space, and therefore, generation of bubbles is facilitated.

When, at an intermediate part of the receiving member's flow path, there is a space whose diameter is larger than the diameters of other portions of the flow path, tap water becomes agitated in that space, which facilitates the generation of bubbles.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF EXPLANATION OF THE DRAWINGS

The present invention is illustrated by way of example, and not by limitation, in the figures of the accompanying drawings, wherein elements having the same reference numeral designations represent like elements throughout and wherein.

EXPLANATIONS OF THE ALPHANUMERIC CHARACTERS USED IN THE FIGURES

Figure 1:
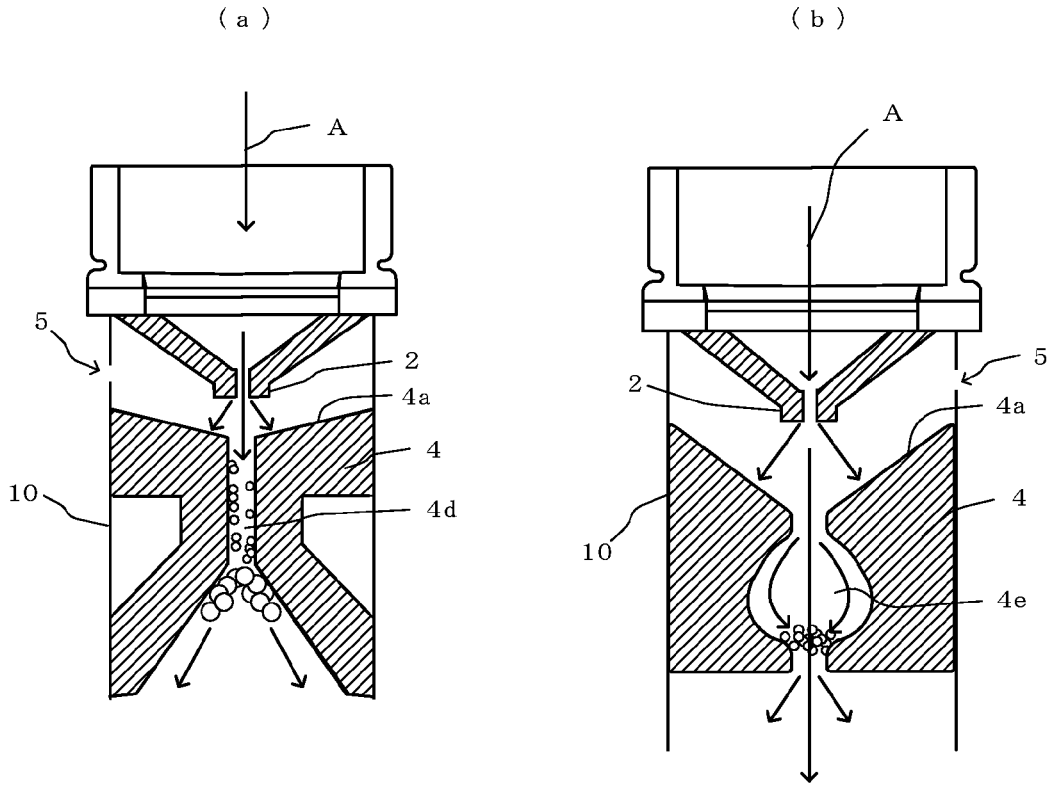
FIGS. 1(*a*) and 1(*b*) two different bubble-generating structures of the present invention.

2 water-discharging nozzle
4 receiving member
4*d* flow path
5 air hole
7 cartridge
7*a* ceramic ball
8 ventilation hole
10 pipe
13 reverse-flow-prevention member
14 air-intake device
15 second through-hole
15*a* indentation
18 plate-like member
20 showerhead
20*b* water-discharging piece
21 base-end member
30 suction member
30*a* first through-hole
40 piping

DETAILED DESCRIPTION OF THE INVENTION

FIGS. 1(*a*) and 1(*b*) respectively show two different bubble-generating structures of the present invention.

The bubble-generating structure shown in FIG. 1(*a*) includes a water-discharging nozzle 2, which is provided on the water-inlet end of the structure and has a diameter smaller than that of the water (liquid)-discharge end of the structure, and a receiving member 4, which is provided at a distance of about 1 cm-2 cm from the water-discharging nozzle 2 (the exact distance can vary, depending on the purpose for which the structure will be used), and both the water-discharging nozzle 2 and the receiving member 4 are provided inside a tubular pipe 10 that has an air hole 5; and a receiving surface 4*a*—which is situated opposite the water-discharging nozzle 2—of the receiving member 4 is formed in a way so as to be indented in the direction in which the liquid flows. The receiving member 4 also has a flow path 4*d* in the center of the receiving surface 4*a*, for collecting and passing the water emitted from the water-discharging nozzle 2. The flow path 4*d* has a diameter larger than that of the water-discharging nozzle 2, so that water can easily pass along the flow path 4*d*. The bubble-generating structure in FIG. 1(*b*) is basically identical to the structure shown in FIG. 1(*a*), but it has—at the intermediate part of the flow path 4*d* (not identified in FIG. 1 (*b*)) of the receiving member 4—a space 4*e* whose diameter is larger than the diameter of the flow path 4*d*.

In the bubble-generating structure of the present invention, water A (shown by arrows in FIG. 1) bursts into the pipe 10 from the water-discharging nozzle 2, and the main stream of that bursting water plunges into the flow path 4*d* of the receiving member 4, which causes the surrounding air to flow out together with the water A, and therefore the inside pressure of the pipe 10 is temporarily reduced. However, because the air hole 5 is provided in the pipe 10, air continues to be supplied into the pipe 10. Thus, the air, which has been made to flow out together with the water A, is agitated together with the water A in the flow path 4*d* of the receiving member 4. Therefore, by the time that the air is discharged from the receiving member 4, the water has come to contain a large amount of bubbles. Incidentally, in the space 4*e* shown in FIG. 1(*b*), particles of the water A, which flows along the walls of the space 4*e*, collide with each other in the center part of the space 4*e*, and they are agitated together with the air that has been taken inside the tubular pipe 10. Therefore, by the time that the water A is discharged from the receiving member 4, the water A contains a large amount of bubbles.

Figure 2:
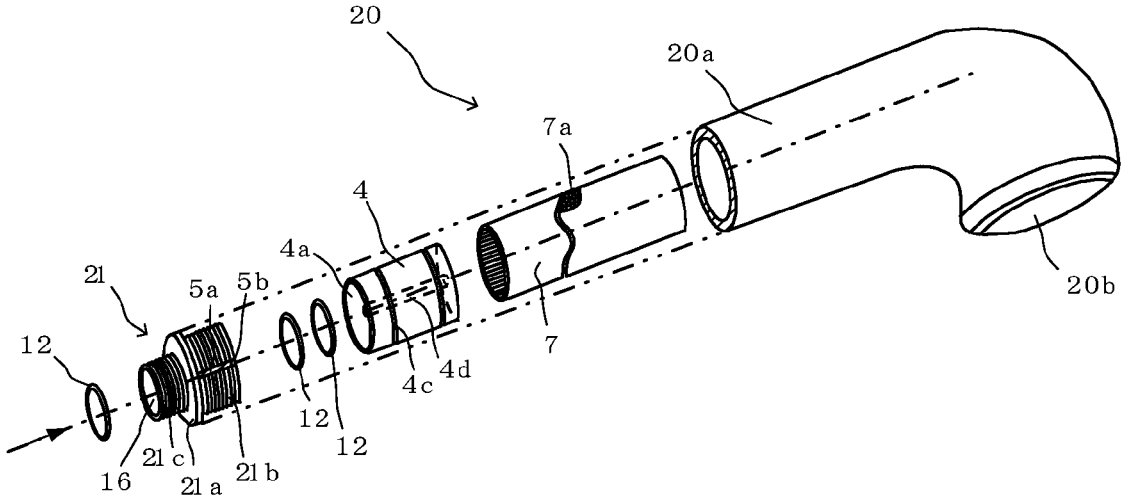
FIG. 2 shows the showerhead of the first embodiment of the present invention.
Figure 3:
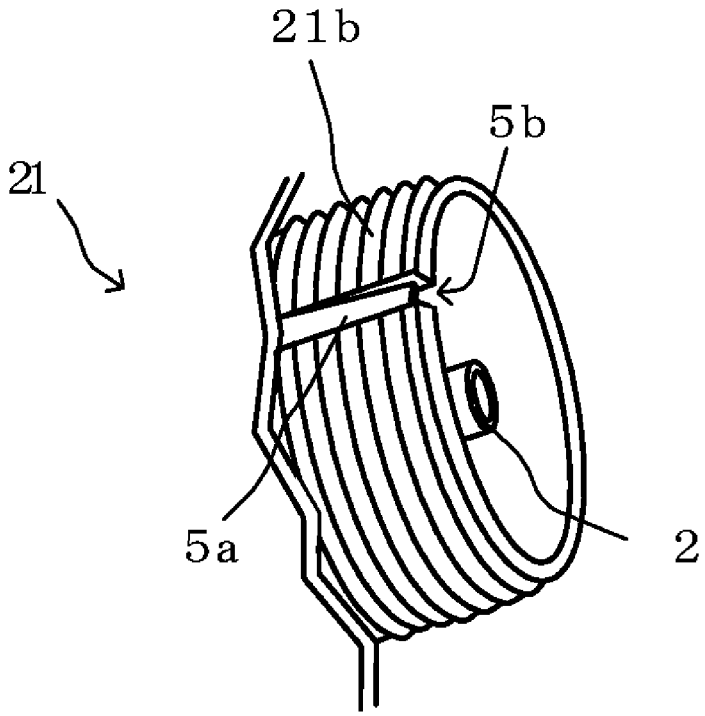
FIG. 3 shows the base-end member of the showerhead.

FIG. 2 shows a showerhead 20 of the first embodiment of the present invention. The showerhead 20 has a water-discharging piece 20*b* at its top and a base-end member 21 at its base (FIG. 3 shows an enlarged view of the base-end member 21). A bubble-generating structure, consisting of the base-end member 21 and the receiving member 4, is provided inside the hollow, outer member 20*a* of the showerhead body. Tap water that has passed through the receiving member 4 then passes—in the form of water containing a large amount of bubbles—through a cartridge 7 that is filled with ceramic balls 7*a*. The outer member 20*a* and the base-end member 21 of the showerhead body are screwed to each other, which means they can be attached to and detached from each other. Therefore, the cartridge 7 and other parts that are inside the showerhead body, can be replaced by new ones.

Figure 4:
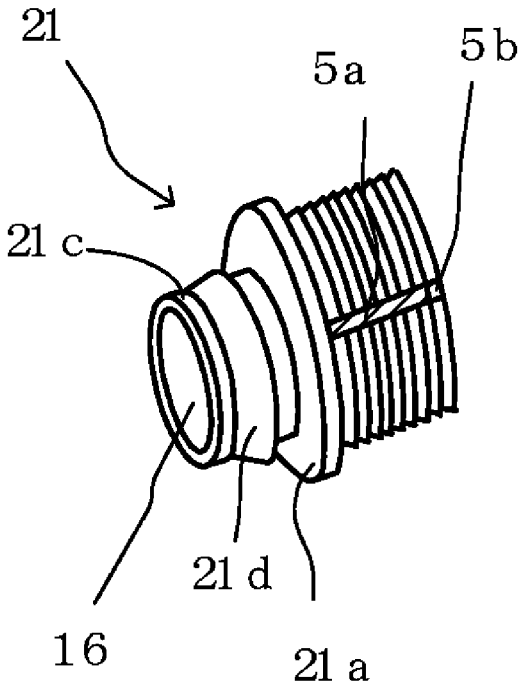
FIG. 4 shows the base-end member of the variational embodiment of the showerhead.

The base-end member 21 has an inside mounting part 21*b* that is screwed to the outer member 20*a*, a flange 21*a* that contacts the water-inlet end of the outer member 20*a*, and an outside mounting part 21*c* that is formed so as to be mounted to a tap-water outlet via a hose or the like. The base-end member 21 has—inside the mounting part 21*b*—a water-discharging nozzle 2 that has a diameter smaller than that of the water inlet. A groove part 5*a* that is inclined in the mounting direction is provided at one part of the outside of the inside mounting part 21*b*, and the top of the outside has an opening that constitutes the air hole 5. Although FIG. 2 shows that the outer periphery of the mounting part 21*c* is threaded, one part of the outer periphery of the mounting part 21*c* can be projected (as shown in FIG. 4) so that the mounting part 21*c* can be fitted with and mounted to—in a one-touch manner—a tap-water outlet.

The receiving member 4 has an O-ring mounting groove 4*c* on its outside. While an O-ring 12 is fitted with the groove 4*c*, the receiving member 4 is mounted to the inside of the outer member 20*a*. Also, the receiving member 4*a*—which is opposite the water-discharging nozzle 2—of the receiving member 4 is indented in the direction in which the liquid flows. The flow path 4*d*, having a diameter larger than that of the water-discharging nozzle 2, is formed so as to penetrate through the center of the receiving surface 4*a*.

Figure 5:
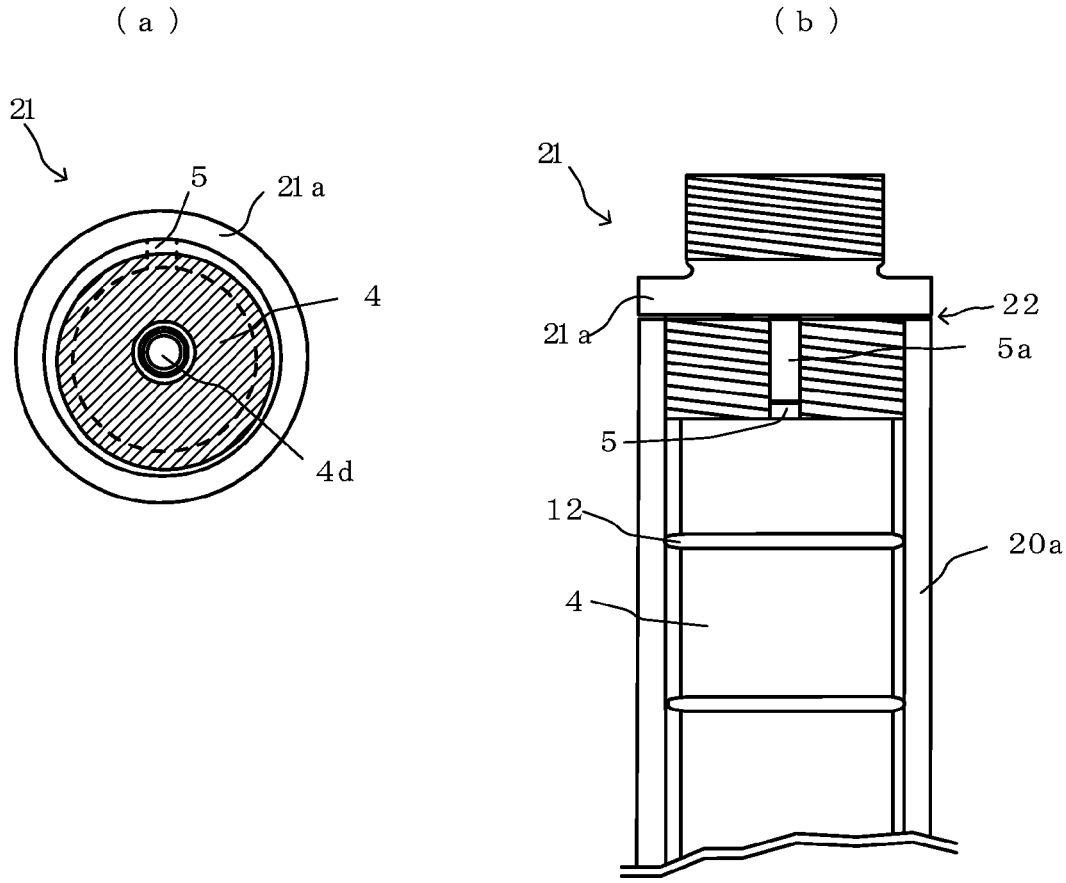
FIG. 5(*a*) is a plane view of the interior structure of the showerhead of the first embodiment when the base-end member is in contact with the receiving member inside the outer member, and FIG. 5(*b*) is a front view thereof.

FIG. 5 shows the condition when the base-end member 21 is in contact with the receiving member 4 inside the outer member 20*a*. FIGS. 5(*a*) and 5(*b*) are a plane view and a front view, respectively. As shown in FIG. 5, even when the receiving member 4 is in contact with the base-end member 21, the air hole 5 is open. Accordingly, even when the base-end member 21 is screwed to and mounted with the outer member 20*a* of the showerhead body, the place where the flange 21*a* contacts the outer member 20*a* is not sealed by an O-ring or the like, and therefore a small space 22 exists there. Air can be taken through this small space 22 into the flow path 4*d* of the receiving member 4. Incidentally, under the condition that the receiving member 4 is in contact with the base-end member 21, the distance from the top of the water-discharging nozzle 2 to the inlet of the flow path of the receiving member 4 is about 1 cm. The base-end member 21 that has the water-discharging nozzle 2 can be integratedly formed with the receiving member 4, so that the base-end member 21 and the receiving member 4 have a unified shape. It is also possible to configure the showerhead 20 such that the diameter of the flow path of the receiving member 4 is enlarged at its intermediate part—as shown in FIG. 1—so as to form a large space there.

As described above, the showerhead 20 of the present invention is constituted such that tap water passes through the receiving member 4, comes to contain a large amount of bubbles, and then passes through the cartridge 7, which is filled with ceramic balls 7*a* that activate the tap water. Furthermore, by the time that the water is discharged from the receiving member 4, the water has come to contain a large amount of bubbles, and this gives a healthy and comfortable feeling to a person who takes a shower using this showerhead.

Figure 6:
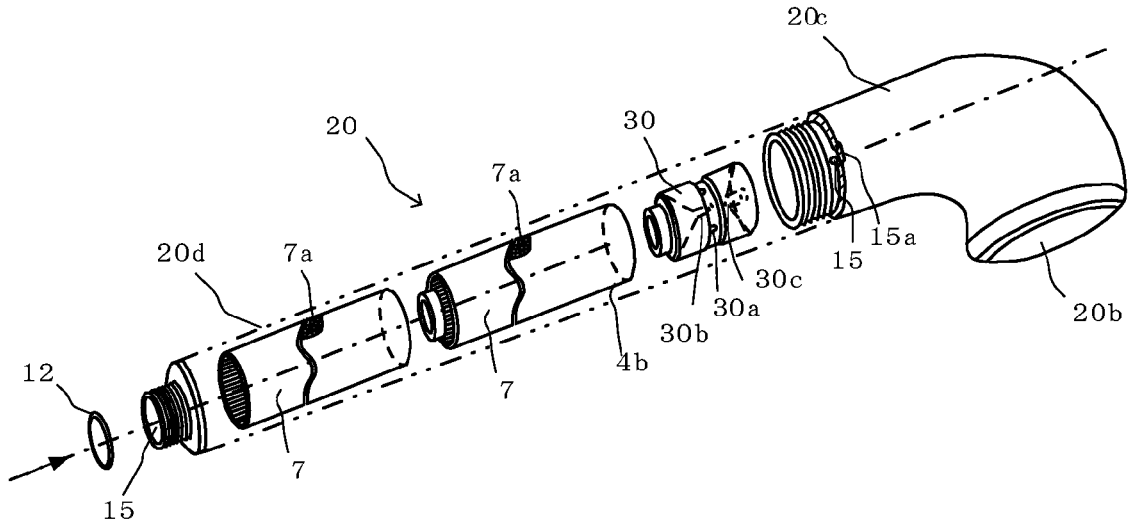
FIG. 6 shows the showerhead of the second embodiment of the present invention.

FIG. 6 shows the showerhead 20 of another embodiment.

This showerhead 20 includes a hollow, head member 20*c* that has a water-discharging piece 20*b* for discharging tap water, a hollow, gripping part 20*d* which is grippable with a hand and screwed with the head member 20*c*, a suction member 30 (see FIG. 7) which sucks air into the inside so as to generate bubbles, and a cartridge 7 filled with ceramic balls 7*a*.

Figure 7:
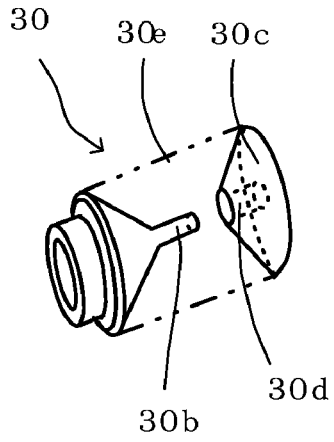
FIG. 7 shows a suction member of the second embodiment.

As shown in FIG. 7, the suction member 30 has of a water-discharging nozzle 30*b* inside a tubular member 30*e*, and a receiving member 30*c*, to which a flow path 30*d* is provided, wherein the receiving member 30*c* is opposed to, and spaced from, the water-discharging nozzle 30*b* at an interval of about 5 mm.

A first through-hole 30*a* is provided between the water-discharging nozzle 30*b* and the receiving member 30*c*, in a way to penetrate through the wall of the tubular member 30*e*.

Also, an indentation 15*a* is provided to one part of a head member 20*c* at the place where the head member 20*c* contacts the gripping member 20*d*. Further, a second through-hole 15 is provided at a portion that is screwed to the gripping part 20*d*, so that air can be taken in from the indentation 15*a*.

As a result, air can be taken in through the first and second through-holes (30*a*, 15) due to the suction force that is generated when the tap water emitted from the water-discharging nozzle 30*b* passes along the flow path 30*d*, so that the water can be discharged. In this embodiment's showerhead 20, bubbles are generated after the tap water has passed through the ceramic balls 7*a*, and therefore tap water discharged from the water-discharging piece 20*b* contains a large amount of bubbles.

Figure 8:
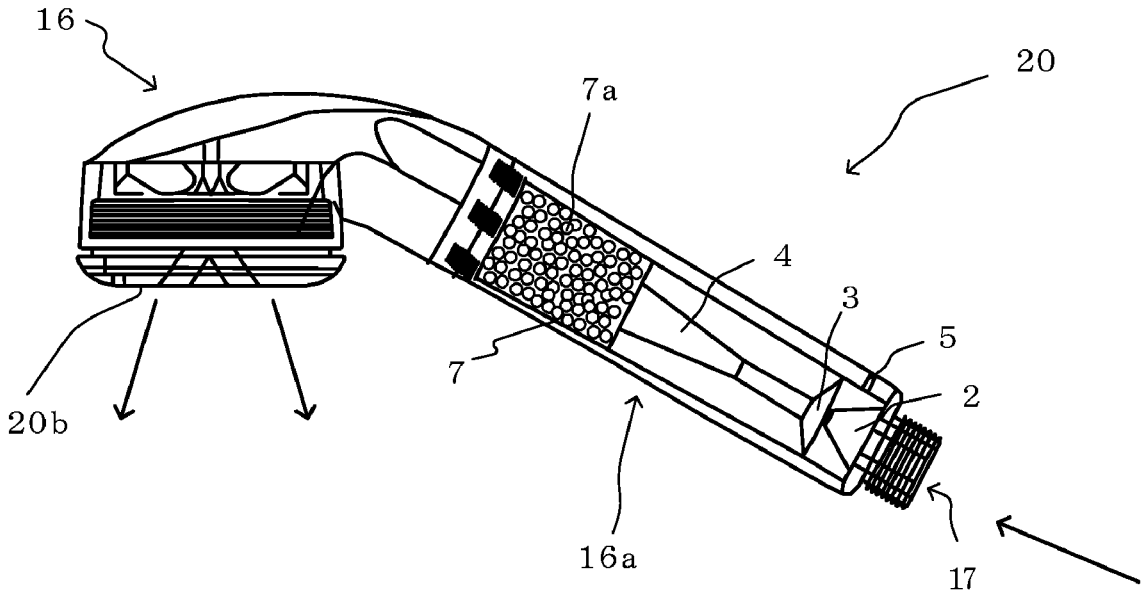
FIG. 8 shows a showerhead, of the third embodiment, having a bubble-generating structure.
Figure 9:
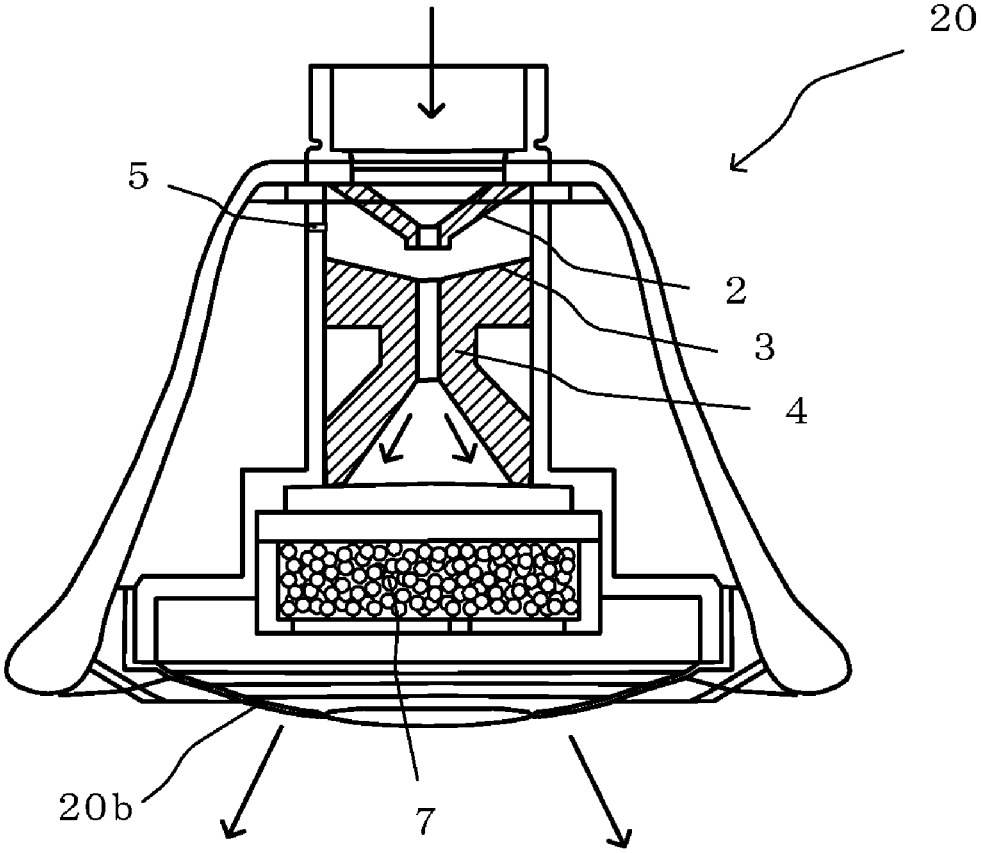
FIG. 9 is a cross-sectional view of a showerhead of the forth embodiment, having a bubble-generating structure.

FIGS. 8 and 9 respectively show showerheads 20 in other embodiments. The showerhead 20 shown in FIG. 8 is formed in a detachable manner, by screwing a shower-generating head part 16 to a grip part 16*a*. The grip part 16*a* is a transparent cylindrical member in which an air hole 5 is formed, and the grip part 16*a* includes a water-discharging nozzle 2, a receiving member 4 that has a receiving part 3, and a cartridge 7 that is filled with ceramic balls 7*a*. The water-discharging nozzle 2 is a funnel-like member whose diameter gradually decreases in the discharge direction (i.e., the nozzle's top), and the water-discharging nozzle 2 is configured such that tap water (shown by the darker arrows in FIG. 8) that is supplied via a water inlet 17 (the showerhead's base end, to which tap water is supplied) bursts out from the water-discharging nozzle 2. Also, the receiving member 4 includes a receiving part 3 that is formed like a funnel so as to receive the bursting-out tap water, and the receiving member 4 is formed in such a way that its diameter gradually increases in the discharge direction (i.e., the direction in which the water flows). In addition, a small space is provided between the water-discharging nozzle 2 and the receiving part 3. As a result, due to the bursting flow of the tap water from the water-discharging nozzle 2 to the receiving member 4, air can be taken in from the air hole 5.

The air supplied from the air hole 5 is drawn to the tap water that bursts out from the water-discharging nozzle 2, and the air and water are mixed in the receiving member 4. The tap water, which has become bubbly, is taken into the ceramics cartridge 7, where it collides hard with the ceramic balls 7*a*. As a result, the tap water is activated under the influence of the ceramic balls 7*a*. That is to say, the bubbly tap water collides with the ceramic balls 7*a*, which stimulates the ceramic balls 7, which then effectively exert an activating action, such as generation of far infrared rays, on the tap water. Also, the tap water, part of which has become bubbly, is emitted from the water-discharging piece 20*b* of the shower generating head part 16. In this manner, because the tap water, part of which has become bubbly, is emitted from the showerhead 20, that water feels soft to a person taking a shower using the showerhead 20. Furthermore, because the tap water, part of which has become bubbly, is emitted from the showerhead 20, a user of the showerhead 20 can wash his or her body using only one-half of the amount of tap water usually used, which saves water and eliminates waste.

The showerhead 20 shown in FIG. 9 is a stationary type that is directly mounted to a wall or the like of a bathing room. It does not have a grip part that can be gripped by a person's hand. However, even that type of showerhead 20 can be provided with a bubble-generating structure that includes a water-discharging nozzle 2, a receiving member 4 that has a receiving part 3, and an air hole 5. It is possible to take bubbly tap water into a ceramics cartridge 7 and to make the tap water collide hard with the ceramic balls 7*a*.

Figure 10:
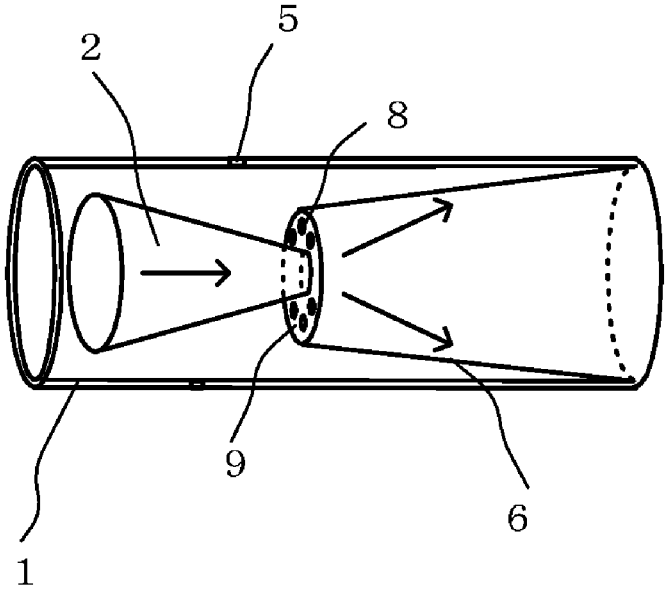
FIG. 10 shows a bubble-generating structure of the other embodiment.

FIG. 10 shows a bubble-generating structure of another embodiment that is arranged in a showerhead. As shown in FIG. 10, the bubble-generating structure in this embodiment has—inside a tubular case 1—a water-discharging nozzle 2 and an enlarged-diameter member 6 whose diameter increases in the discharge direction.

The top of the water-discharging nozzle 2 is connected to the bottom 9 of the enlarged-diameter member 6. The bottom 9 of the enlarged-diameter member 6 has a diameter larger than that of the top of the water-discharging nozzle 2, and ventilation holes 8 are provided around the place at which the bottom 9 of the enlarged-diameter member 6 connects with the top of the water-discharging nozzle 2.

Figure 11:
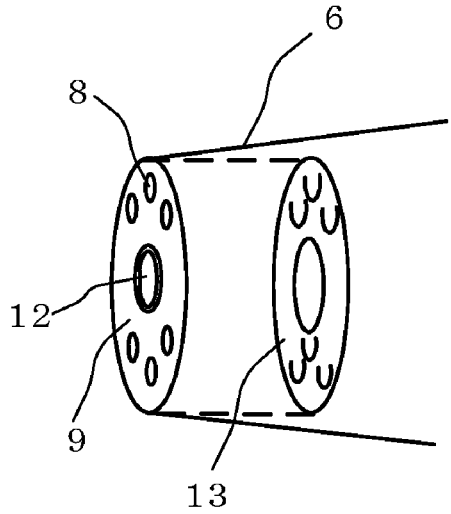
FIG. 11 shows the interior structure of the bubble-generating structure shown in FIG. 10.

FIG. 11 shows that a reverse-flow-prevention member 13, which is made of a flexible material such as rubber, is provided inside the bottom 9 of the enlarged-diameter member 6 and is adhered to the bottom 9. In this reverse-flow-prevention member 13, a portion corresponding to a water-passing port 12 is cut away, while portions corresponding to the ventilation holes 8 are not cut away, but are cut to have U-shapes so that they have larger diameters than those of the outer peripheries of the ventilation holes 8. As a result, tap water flowing in from the water-discharging nozzle 2 is allowed to enter the enlarged-diameter member 6. Air, being drawn to the tap water that bursts in through the water-discharging nozzle 2, flows in through the ventilation holes 8. In addition, reverse flow of the tap water through the ventilation holes 8 is prevented. By providing such a bubble-generating structure to the showerhead 20, it is possible to cause the discharged tap water to contain a large amount of bubbles.

Figure 12:
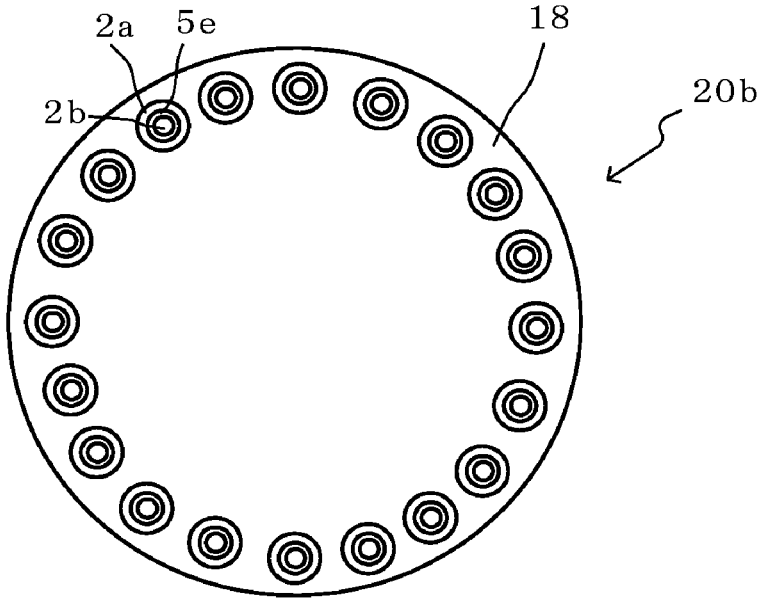
FIG. 12 shows a face view of the water-discharging piece of the showerhead of the present invention.
Figure 13:
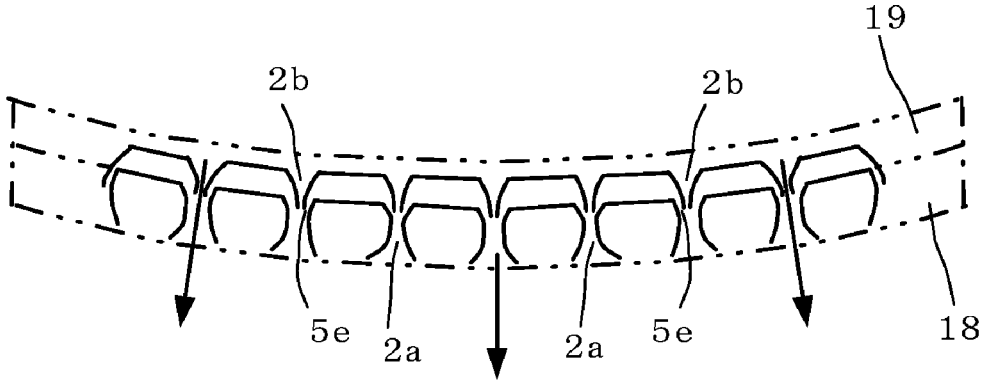
FIG. 13 shows the water-discharging piece of the showerhead shown in FIG. 12.

FIGS. 12 and 13 show the structure of the showerhead's water-discharging piece 20*b*, in which a plate-like member 19 that has nozzle-like holes 2*b* is overlaid on a plate-like member 18 having nozzle-like holes 2*a*. The nozzle-like holes 2*a* and 2*b* are spaced slightly apart, so that air holes 5*e* are formed. Air, which comes in from the spaces between the nozzle-like holes 2*a* and 2*b*, is supplied into the air holes 5*e*.

Accordingly, due to the outflow of the tap water squirting out of the water-discharging piece 20*b*, the air bursts out of the air holes 5*e*. Thus, the tap water mixes with the air, and water that feels soft to a person using the showerhead is discharged.

Figure 14:
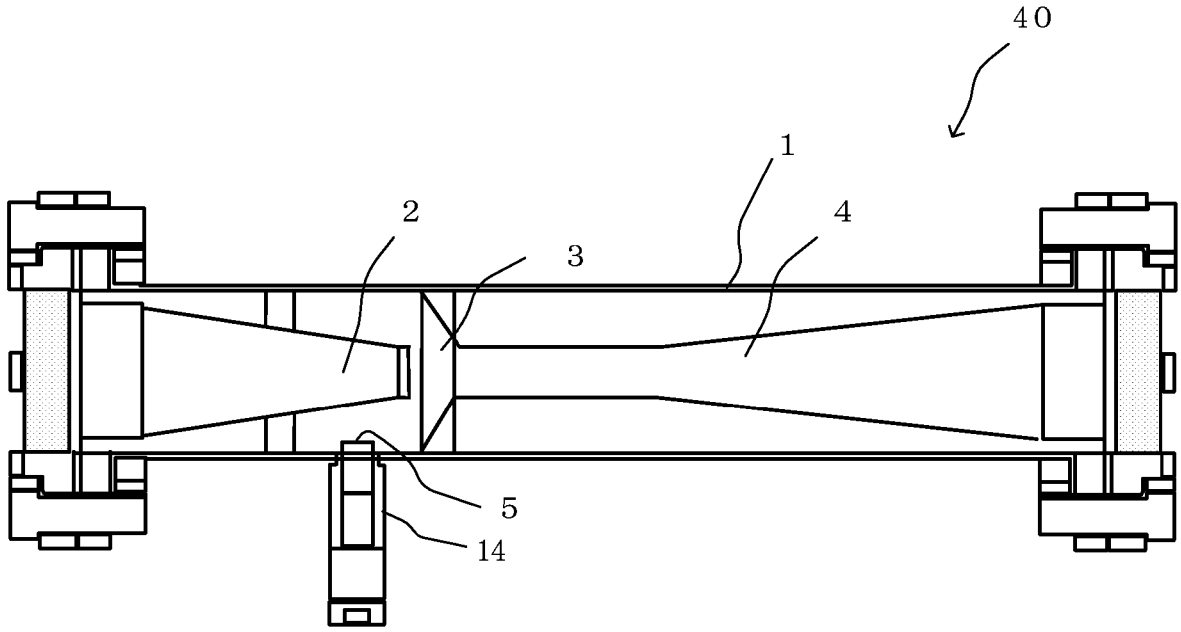
FIG. 14 shows piping that includes a bubble-generating structure.

FIG. 14 shows piping 40 that is used for purifying lake water or river water. Inside the piping 40 is provided the above-mentioned bubble-generating structure—i.e., the water-discharging nozzle 2, the receiving member 4, and the air hole 5. Depending on where the piping 40 is to be installed, the water or the liquid passing through the piping might not be allowed to leak out. For this reason, an air-intake device 14, in which a return-check valve is installed, is provided in the air hole 5.

Furthermore, the air-intake device 14 can include a flowmeter or filter (not shown), and the air-intake device 14 can be connected with a compressed-gas cylinder, so as to aggressively feed in compressed air and to adjust the amount of bubbles contained in the discharging water or other liquid. In addition, what is to be mixed in the bubble-generating structure is not limited to the combination of water and air. Depending on the purpose, the combination can be any of the following, as appropriate: water and hydrogen or ozone; cooking oil and nitrogen gas; drinking water and carbon dioxide gas; and so on. As a result, the bubble-generating structure can be utilized in purifying liquids, preventing oxidation of oil, and manufacturing health drinks—which activities are conducted in a food manufacturing plant, a purification facility, or other comparable place. The bubble-generating structure can also be utilized—by using chlorine gas—in purifying water in a swimming pool and so on.

It will be readily seen by one of ordinary skill in the art that the present invention fulfils all of the objects set forth above. After reading the foregoing specification, one of ordinary skill in the art will be able to affect various changes, substitutions of equivalents and various aspects of the invention as broadly disclosed herein. It is therefore intended that the protection granted hereon be limited only by definition contained in the appended claims and equivalents thereof.

What is claimed is:

1. A showerhead, comprising:

a mounting base-end member configured to be mounted to a water outlet, the base-end member disposed at a base end of a tubular outer member, the base-end member including:

a flange that contacts a water-inlet end of the outer member, an inside mounting part that projects inward from the flange and is affixed to the inside the outer member, an outside mounting part that projects outward from the flange, a groove part, inclined in a mounting direction, is disposed along one part of the outside of the inside mounting part, and an air hole at an end of the groove part most distant from the flange; and a showerhead, including:

an interior nozzle, disposed in the base-end member and has a diameter smaller than that of the water outlet, and a receiving member situated downstream of, and at a specified distance from and opposite to, the interior nozzle the receiving member including a funnel shaped receiving surface having a downstream disposed apex, and a flow path in the center of the receiving surface for passing water emitted from the interior nozzle, and a space provided at an intermediate part of a flow path of the receiving member, the diameter of the space being larger that diameters of other portions of the flow path;

wherein air is taken in at a location where the outer member contacts the base-end member, and due to a suction force generated when the water, emitted from the interior nozzle, passes along the flow path, the air is taken in and the water is discharged.

* * * * *